United States Patent [19]

Williams

[11] 4,274,507

[45] Jun. 23, 1981

[54] PORTABLE SUPPORT FOR A SCAFFOLD

[76] Inventor: Albert Williams, 4506 Laurel Ave., Omaha, Nebr. 68104

[21] Appl. No.: 62,723

[22] Filed: Aug. 1, 1979

[51] Int. Cl.[3] ..... E04G 3/10

[52] U.S. Cl. ..... 182/12; 182/63; 182/142; 182/150

[58] Field of Search ..... 182/142, 150, 12, 14, 182/143, 36, 63; 254/139.1

[56] References Cited

U.S. PATENT DOCUMENTS

| | | | |
|---|---|---|---|
| 3,550,723 | 12/1970 | Gentry | 182/36 |
| 3,578,290 | 5/1971 | Gof | 254/139.1 |
| 3,608,670 | 9/1971 | Blake | 182/142 |
| 3,854,550 | 12/1974 | Shingler | 182/142 |
| 4,074,789 | 2/1978 | Warren | 182/14 |
| 4,130,179 | 12/1978 | Williams | 182/142 |

*Primary Examiner*—Reinaldo P. Machado
*Attorney, Agent, or Firm*—Zarley, McKee, Thomte, Voorhees & Sease

[57] ABSTRACT

A portable support for a scaffold comprising first and second wheeled support members which are adapted to be placed on the building roof. The support members are interconnected by length adjustable braces to enable the distance between the support members to be varied. Handrails are also provided on the wheeled support members which extend therebetween to enable the entire assembly to be easily moved as a unit. The first support member has a plurality of upstanding posts secured thereto for selectively vertically receiving one end of an elongated scaffold support arm. The second support member has a pair of posts secured thereto and extending upwardly therefrom for receiving the scaffold support arm therebetween. The scaffold support arm is also length adjustable to enable the distance between the support members to be varied. An electric motor is mounted on the first support member and is operatively connected to an elongated axle which is secured to a pair of wheels on each of the support members and is adapted to drive the first and second support members as a unit along the building roof.

6 Claims, 4 Drawing Figures

PORTABLE SUPPORT FOR A SCAFFOLD

BACKGROUND OF THE INVENTION

This invention relates to a support for a scaffold and more particularly to a portable scaffold support.

Many types of scaffold support devices have been provided for supporting a scaffold along one side of a building or the like. Ordinarily, long timbers or poles are extended over the side of the building and are sandbagged or the like to maintain the same in position. The scaffolds are supported on the outer ends of the timbers. When is it necessary to move the scaffold along the side of the building, it is necessary to completely disassemble the entire structure and to laboriously move the sandbags to the new position.

Certain types of scaffold supports have been designed to overcome the shortcomings of the previously described support and applicant has been granted U.S. Pat. No. 4,130,179 for such an improvement. The instant invention represents an improvement over applicant's earlier patent in that means is provided to more conveniently move the assembly on the building roof. Further, means is provided for adjusting the distance between the first and second support members which was not found on applicant's earlier patent.

Therefore, it is a principal object of the invention to provide an improved support for a scaffold.

A further object of the invention is to provide a portable support for a scaffold.

A still further object of the invention is to provide a scaffold including a pair of spaced-apart support members which are interconnected by length-adjustable braces or the like to enable the distance therebetween to be varied.

A further object of the invention is to provide a portable support for a scaffold comprising first and second scaffold support members which are moved as a unit by an electric motor mounted on one of the scaffold support members.

A further object of the invention is to provide a portable support for a scaffold which is comprised of a plurality of individual components which may be assembled on the roof in a convenient manner.

A further object of the invention is to provide a portable support for a scaffold which is convenient and safe to use.

These and other objects will be apparent to those skilled in the art.

DESCRIPTION OF THE PREFERRED EMBODIMENT

Figure 1:
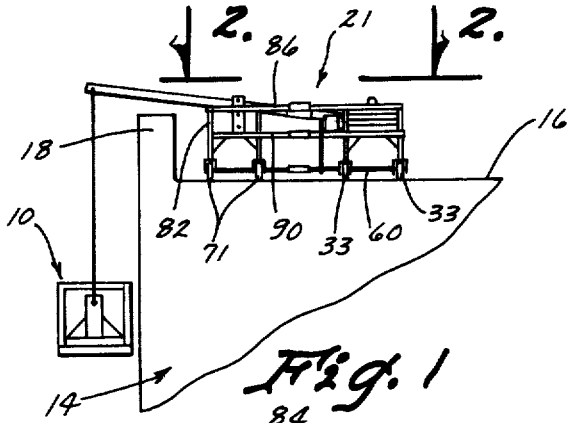
FIG. 1 is a side view of the scaffold being used on a building.
Figure 2:
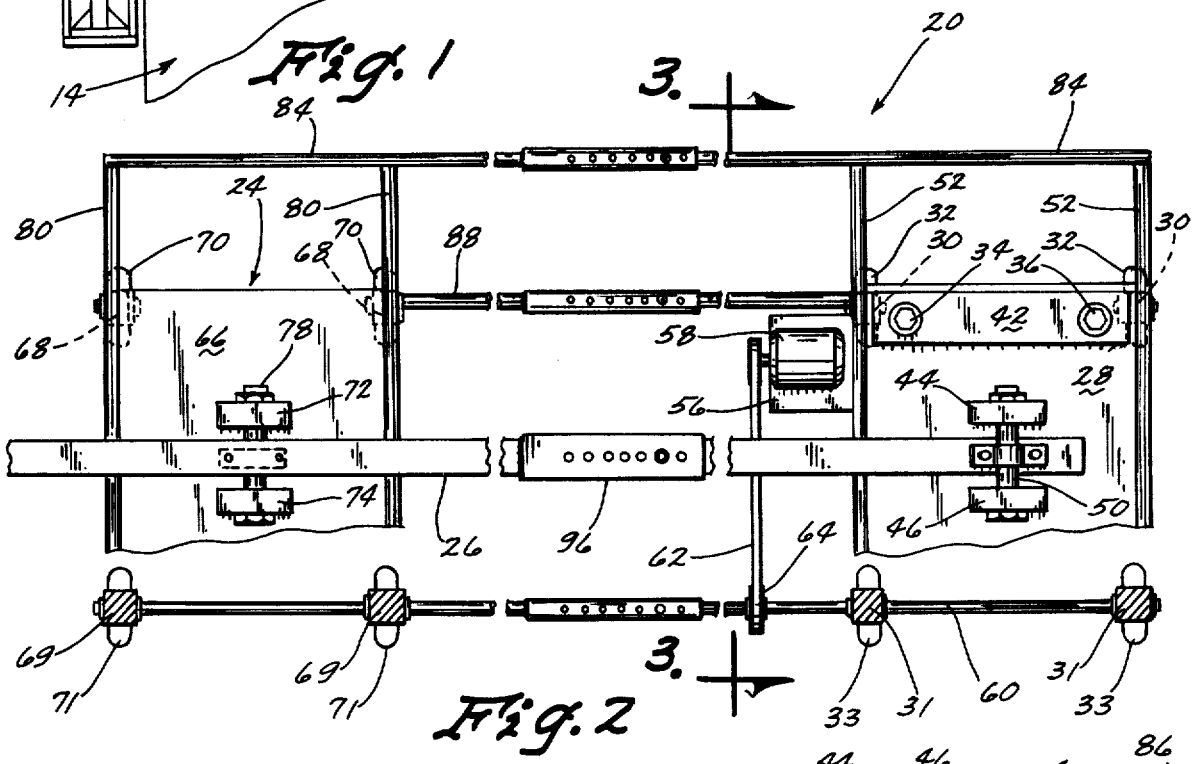
FIG. 2 is a partial top view of the apparatus.
Figure 4:
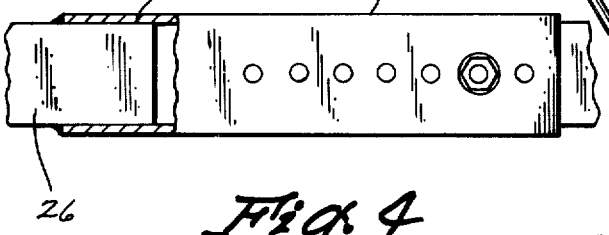
FIG. 4 is a partial view of the extension for the support arm.
Figure 3:
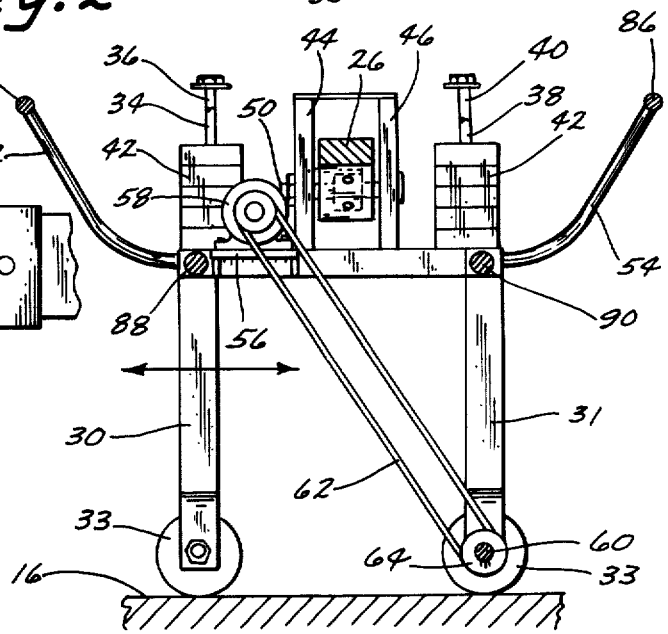
FIG. 3 is a sectional view as seen on lines 3—3 of FIG. 2.

The numeral 10 refers generally to a conventional scaffold which is normally positioned along the face or side of a building 14. The scaffold may include means for raising and lowering the same relative to the building. For purposes of description, the building 14 will be described as including a roof 16 and a ledge 18.

The support of this invention is referred to generally by the reference numeral 20 and generally comprises supports 22 and 24 and support arm 26. Support 22 generally comprises bed 28 having pairs of legs 30 and 31 extending downwardly therefrom which have caster wheels 32 and 33 on the lower ends thereof respectively. A pair of posts 34 and 36 are secured to the bed 28 and extend upwardly therefrom as do posts 38 and 40 (not shown). Posts 34, 36 and 38, 40 are adapted to receive a plurality of weights 42 thereon as seen in the drawings. The number of weights positioned on the posts will depend upon the weight being supported from the member 26. A pair of posts 44 and 46 are secured to the bed 28 and extend upwardly therefrom and are provided with a plurality of vertically spaced openings formed therein adapted to receive the bolt 50. One end of the arm 26 is selectively vertically received between the posts 44 and 46 and secured thereto by means of the bolt 50. Support 22 is provided with pairs of handles 52 and 54 secured to opposite sides thereof and extending upwardly therefrom.

Plate 56 is secured to bed 28 and extends forwardly therefrom adapted to support an electric motor 58 thereon. Motor 58 is operatively connected to axle 60 by V-belt 62. Axle 60 is length adjustable and is operatively connected to the wheels 33 on the support 22 for driving the same. As will be described in detail hereinafter, axle 60 is also connected to a pair of wheels on the support 24. As seen in the drawings, V-belt 62 extends around pulley 64 which is mounted on the axle 60.

Support 24 generally comprises bed 66 having pairs of legs 68 and 69 extending downwardly therefrom which have caster wheels 70 and 71 on the lower ends thereof. A pair of posts 72 and 74 are secured to the bed 66 and extend upwardly therefrom. Posts 72 and 74 are provided with a plurality of vertically spaced openings formed therein adapted to receive bolt 78. As seen in the drawings, arm 26 extends between posts 72 and 74 and is selectively vertically secured thereto by means of the bolt 78 extending therethrough. Support 24 is provided with pairs of handles 80 and 82 secured thereto and extending upwardly therefrom.

Brace 84 is secured to the pair of handles 52 on support 22 and is secured to the pair of handles 80 on support 24 and extends therebetween. Likewise, brace 86 is secured to the pair of handles 54 and support 22 and to the handles 84 on support 24 and extends therebetween. Braces 84 and 86 are length adjustable to permit the distance between the supports 22 and 24 to be varied. The braces 84 and 86 enable the entire assembly to be moved as a unit and provides a more convenient means of moving the assembly than in applicant's previous patent. Likewise, a pair of length-adjustable braces 88 and 90 are secured to and extend between the supports 22 and 24 to connect the supports together while permitting the distance between the two supports to be varied as required. The interconnection of the supports 22 and 24 by the various braces also enables the entire assembly to be easily moved as a unit and maintains the supports in position with respect to each other.

Axle 60 is secured to the caster wheels 60 on support 24 so that rotation of the axle 60 by the motor 58 will cause a pair of wheels on each of the supports to be rotated thereby enabling the unit to be moved along the roof of the building in a convenient manner. In applicant's previous device, it was necessary to remove the weights from the rear support prior to moving the assembly on the building roof but in the present invention, the weights need not be removed since the motor 58 provides sufficient driving power to move the assembly along the building roof. It is also recommended that a pair of aluminum plates or the like be positioned beneath the wheels of the supports so that the weight of the assembly is distributed over a wider area on the building roof.

The support arm 26 is also length adjustable by means of a suitable extension member 92. Extension member 92 consists of a sleeve portion 94 which receives the rearward end of the support arm 26 and a rearwardly extending portion 96 including appropriate holes for connection of the support arm 26 to the extension and for the connection of the extension to the rearward wheeled support member 22.

The portable support for a scaffold described herein is much easier to move along the roof of the building than applicant's earlier device. In this invention, the operator need only actuate a switch for the electric motor to have the entire assembly automatically moved in unison. The distance between the supports 22 and 24 is easily varied as required since when the assembly is lengthened, the weight of the rearward wheeled support 24 is afforeded greater leverage and thereby able to support a greater load on the outer end of the support arm 26. The entire assembly can be dismantled into relatively small parts so that it can be taken up to a rooftop on an elevator or through the building stairs without the necessity of raising it up the outside building wall.

The vertical positioning of the support arm 26 relative to support 24 will ordinarily depend upon the height of the ledge 18 with respect to the roof 16. The number of weights placed on the posts 34, 36, 38 and 40 will normally depend upon the weight of the scaffold and the weight being supported thereon. The scaffold itself is secured to the outer end of the arm 26 in conventional fashion. The instant scaffold is easily moved from one location to another location on the building roof without the inconvenience associated with prior art devices.

The support disclosed herein is not only convenient to use but is safe and versatile. Thus it can be seen that the invention described herein accomplishes at least all of its stated objectives.

I claim:

1. A portable support for a scaffold, comprising, a first portable wheeled support member, a plurality of weights on said first support member, an elongated member having one end pivotally connected to
- said first suppport member, a second portable wheeled support member spaced from said first
- support member, said elongated member being connected, intermediate its length,
- to said second support member, the other end of said elongated member being adapted to support
- a scaffold extending downwardly therefrom, and length-adjustable means operatively secured to and extending between said support members whereby, upon extension of said length-adjustable means, the leverage afforded by said plurality of weights is increased.

2. The portable support of claim 1 wherein said length-adjustable means comprises a pair of length-adjustable braces secured to and extending between said support members.

3. The portable support of claim 1 wherein said elongated member is length adjustable.

4. A portable support for a scaffold, comprising, a first portable wheeled support member, a plurality of weights on said first support member, an elongated member having one end pivotally connected to said
- first support member, a second portable wheeled support member spaced from said first
- support member, said elongated member being connected, intermediate its length,
- to said second support member, the other end of said elongated member being adapted to support
- a scaffold extending downwardly therefrom, and length-adjustable means operatively secured to and extending
- between said support members, each of said support members having pairs of handles positioned on opposite sides thereof which extend upwardly therefrom, said length-adjustable means comprising length-adjustable braces secured to and extending between the pairs of handles on said support members.

5. A portable support for a scaffold, comprising, a first portable wheeled support member, a plurality of weights on said first support member, an elongated member having one end pivotally connected to said
- first support member, a second portable wheeled support member spaced from said first
- support member, said elongated member being connected, intermediate its length,
- to said second support member, the other end of said elongated member being adapted to support
- a scaffold extending downwardly therefrom, and a power means on one of said support members for moving
- said support members along a supporting surface, said power means comprising a motor mounted on said first support member, an axle member connected to a pair of wheels on each of said supporting member, said motor being operatively connected to said axle member, said axle member being length-adjustably secured to said wheels.

6. A portable support for a scaffold, comprising, a first portable wheeled support member, a plurality of weights on said first support member, an elongated member having one end pivotally connected to said
- first support member, a second portable wheeled support member spaced from said first
- support member, said elongated member being connected, intermediate its length,
- to said second support member, the other end of said elongated member being adapted to support
- a scaffold extending downwardly therefrom, length-adjustable means operatively secured to and extending between said support members whereby upon extension of said length-adjustable means, the leverage afforded by said plurality of weights is increased, and a power means on one of said support members for moving
- said support members along a supporting surface, said power means comprising a motor mounted on said first support member, an axle means connected to a pair of wheels on each of said support members, said motor being operatively connected to said axle means, and
- said axle means being length-adjustable to accommodate adjustment of said length-adjustable means.

* * * * *